US008250830B2

(12) United States Patent
Struthers et al.

(10) Patent No.: US 8,250,830 B2
(45) **Date of Patent: *Aug. 28, 2012**

(54) DEVICES AND METHODS FOR FLANGELESS INSTALLATIONS

(75) Inventors: Scott Struthers, San Clemenete, CA (US); Ray Call, Mission Viejo, CA (US); Todd Ryan, Riverside, CA (US)

(73) Assignee: Dana Innovations, San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/979,697

(22) Filed: Dec. 28, 2010

(65) Prior Publication Data

US 2011/0138739 A1 Jun. 16, 2011

Related U.S. Application Data

(60) Division of application No. 12/131,459, filed on Jun. 2, 2008, now Pat. No. 8,007,926, which is a division of application No. 11/954,667, filed on Dec. 12, 2007, now Pat. No. 7,461,483, which is a continuation-in-part of application No. 11/566,365, filed on Dec. 4, 2006, now Pat. No. 7,699,138.

(60) Provisional application No. 60/825,162, filed on Sep. 11, 2006, provisional application No. 60/950,237, filed on Jul. 17, 2007.

(51) Int. Cl.
*E04B 1/00* (2006.01)

(52) U.S. Cl. ..... 52/745.15; 52/514.5

(58) Field of Classification Search ..... 52/745.15, 52/514.5, 220.8; 248/205.3
See application file for complete search history.

(56) References Cited

U.S. PATENT DOCUMENTS

| | | | | |
|---|---|---|---|---|
| 3,239,178 | A * | 3/1966 | Pompa | 248/205.3 |
| 3,912,865 | A | 10/1975 | Seebinger | |
| 3,982,370 | A | 9/1976 | Buffington | |
| 4,077,169 | A | 3/1978 | Thaw et al. | |
| 4,296,280 | A | 10/1981 | Richie | |
| 4,465,905 | A * | 8/1984 | Nation | 381/386 |
| 4,763,307 | A | 8/1988 | Massa | |
| 4,778,134 | A | 10/1988 | Stuthers et al. | |
| 4,890,418 | A | 1/1990 | Sachs | |
| 4,910,397 | A | 3/1990 | Sperling | |
| 4,923,032 | A | 5/1990 | Nuernberger | |
| RE33,305 | E | 8/1990 | Thayer | |
| 4,970,836 | A | 11/1990 | Brown | |
| 4,974,698 | A | 12/1990 | Smith | |
| 5,005,792 | A | 4/1991 | Rinderer | |

(Continued)

FOREIGN PATENT DOCUMENTS

EP 0422322 A2 2/1990

(Continued)

*Primary Examiner* — Basil Katcheves
(74) *Attorney, Agent, or Firm* — Fish & Associates, PC

(57) ABSTRACT

A flangeless mounting system, suitable for in-wall speakers and other components, includes a panel that is finished to provide at least a superficially continuous junction between the edges of the panel and the surrounding wall, ceiling, or other structure. A rim advantageously extends outwardly from a first surface of the panel by a small distance, which in currently preferred embodiments is about $1/16^{th}$ inch to $1/8^{th}$ inch,. A collar is preferably installed about the inner edge of the opening, and a receiver is attached to the collar or directly to the panel. Magnetic, threaded, detent, and frictional means are contemplated for maintaining the component in position relative to the receiver.

10 Claims, 12 Drawing Sheets

U.S. PATENT DOCUMENTS

| | | | |
|---|---|---|---|
| 5,082,083 | A | 1/1992 | Draffen |
| 5,096,439 | A | 3/1992 | Arnett |
| 5,221,069 | A | 6/1993 | Struthers et al. |
| 5,263,676 | A | 11/1993 | Medlin, Jr. et al. |
| 5,269,861 | A | 12/1993 | Gilbreath |
| 5,292,092 | A | 3/1994 | Curtis et al. |
| 5,388,795 | A | 2/1995 | Struthers et al. |
| 5,423,500 | A | 6/1995 | Struthers et al. |
| 5,586,934 | A | 12/1996 | Dombrowski et al. |
| 5,598,670 | A | 2/1997 | Humphrey et al. |
| 5,687,532 | A | 11/1997 | Torrey |
| 5,717,171 | A | 2/1998 | Miller et al. |
| 5,721,394 | A | 2/1998 | Mulks |
| 5,730,409 | A | 3/1998 | Baron et al. |
| 6,070,383 | A | 6/2000 | Jeanseau |
| 6,192,640 | B1 | 2/2001 | Snyder |
| 6,268,563 | B1 | 7/2001 | Gretz |
| 6,355,882 | B1 | 3/2002 | Gretz |
| 6,364,053 | B1 | 4/2002 | Huerth |
| 6,391,171 | B1 | 5/2002 | Lommasson |
| 6,405,983 | B1 | 6/2002 | Goj |
| 6,550,570 | B2 | 4/2003 | Combest |
| 6,596,938 | B2 | 7/2003 | Gilleran |
| 6,609,589 | B2 | 8/2003 | Combest |
| 6,807,780 | B2 | 10/2004 | McCahill et al. |
| 6,845,840 | B2 | 1/2005 | Cowan et al. |
| 6,896,833 | B2 | 5/2005 | Chadwick |
| 6,913,369 | B2 | 7/2005 | Chadwick |
| 7,003,129 | B2 | 2/2006 | Hecht |
| 7,032,708 | B2 | 4/2006 | Popken et al. |
| 7,108,394 | B1 | 9/2006 | Swarens |
| 7,130,432 | B2 | 10/2006 | Lee et al. |
| 7,176,377 | B1 | 2/2007 | Gretz |
| 7,292,702 | B2 | 11/2007 | Hagman |
| 7,303,802 | B1 | 12/2007 | Brower et al. |
| 7,316,835 | B1 | 1/2008 | Swanson |
| 7,353,907 | B2 | 4/2008 | Whitaker |
| 7,363,720 | B2 | 4/2008 | DiGavero et al. |
| 2002/0055301 | A1 | 5/2002 | Gorman |
| 2002/0125031 | A1 | 9/2002 | Gilleran |
| 2002/0162702 | A1 | 11/2002 | Kramer |
| 2002/0184845 | A1 | 12/2002 | Horowitz |
| 2003/0042371 | A1 | 3/2003 | McCahill et al. |
| 2003/0110718 | A1 | 6/2003 | Boisvert |
| 2003/0116341 | A1 | 6/2003 | Gilleran |
| 2003/0123679 | A1 | 7/2003 | Dudleston et al. |
| 2003/0155473 | A1 | 8/2003 | Rivera et al. |
| 2003/0159390 | A1 | 8/2003 | Fonesca |
| 2004/0129492 | A1 | 7/2004 | Bertagni et al. |
| 2004/0218777 | A1 | 11/2004 | Hagman |
| 2005/0094362 | A1 | 5/2005 | Stephens |
| 2005/0201571 | A1 | 9/2005 | Saint-Vincent et al. |
| 2005/0252673 | A1 | 11/2005 | Kregle et al. |
| 2006/0050918 | A1 | 3/2006 | Kloman, III |
| 2006/0059829 | A1 | 3/2006 | Flynn |
| 2007/0051862 | A1 | 3/2007 | Monti |
| 2007/0121988 | A1 | 5/2007 | Merrey et al. |
| 2008/0078903 | A1 | 4/2008 | Struthers et al. |
| 2008/0110672 | A1 | 5/2008 | Ryan |
| 2008/0115446 | A1 | 5/2008 | Brinkley |
| 2008/0168723 | A1 | 7/2008 | Bilge |

FOREIGN PATENT DOCUMENTS

| | | | |
|---|---|---|---|
| EP | 0422322 | A3 | 2/1990 |
| EP | 0422322 | B1 | 2/1990 |
| WO | 01/65897 | | 9/2001 |

* cited by examiner

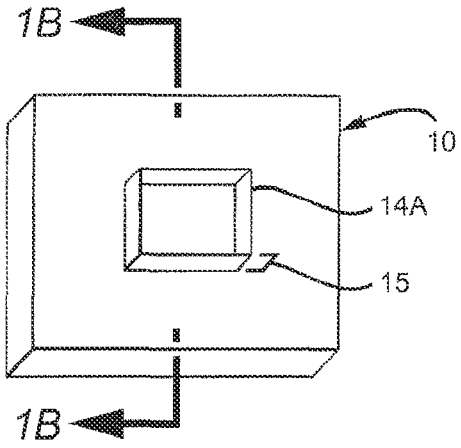
FIG. 1A
PRIOR ART
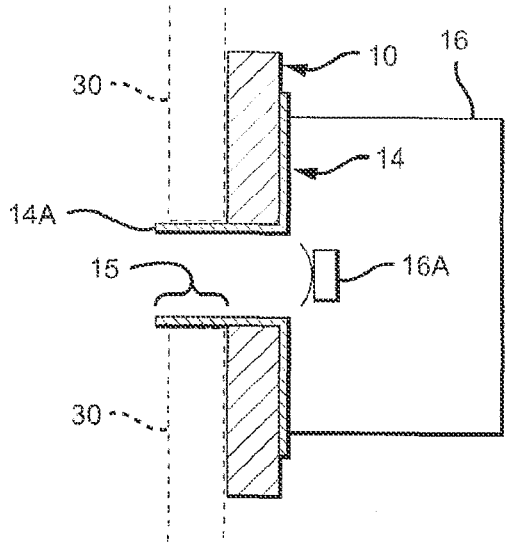
FIG. 1B
PRIOR ART
FIG. 2
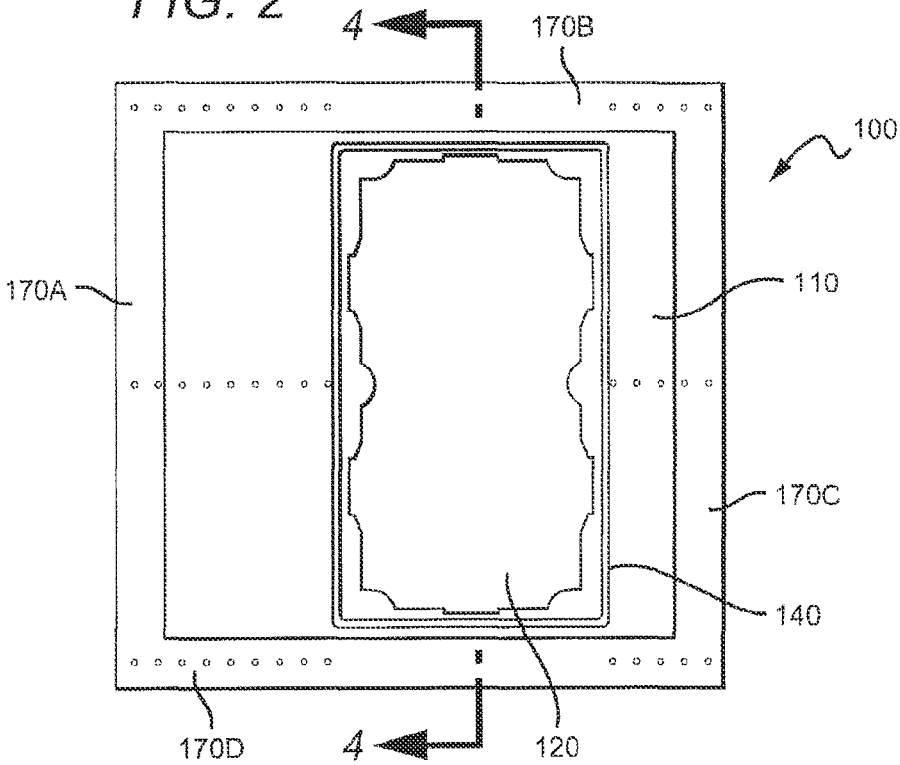

FIG. 3
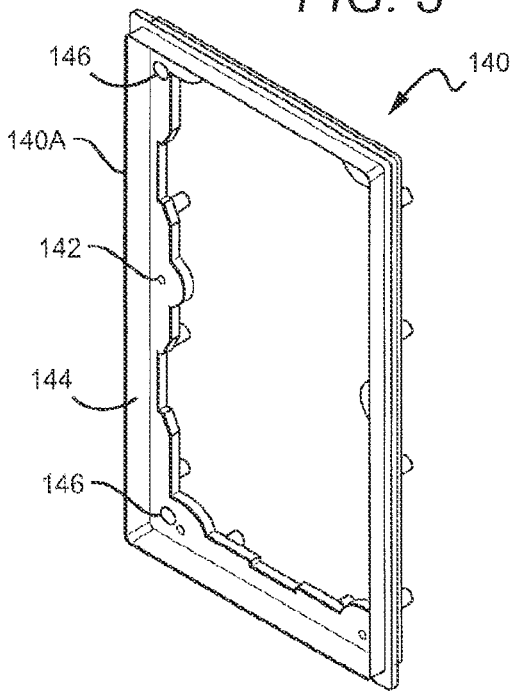
FIG. 4
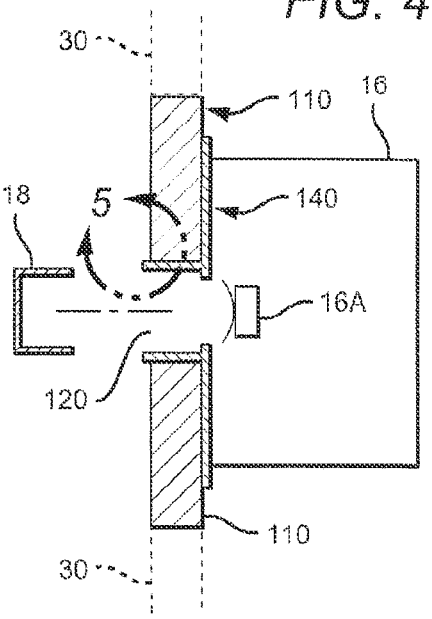
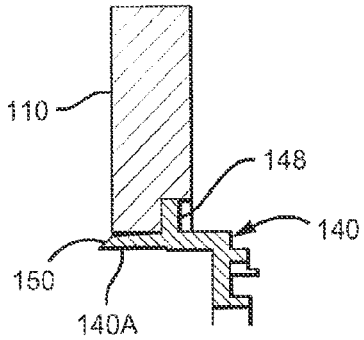
FIG. 5
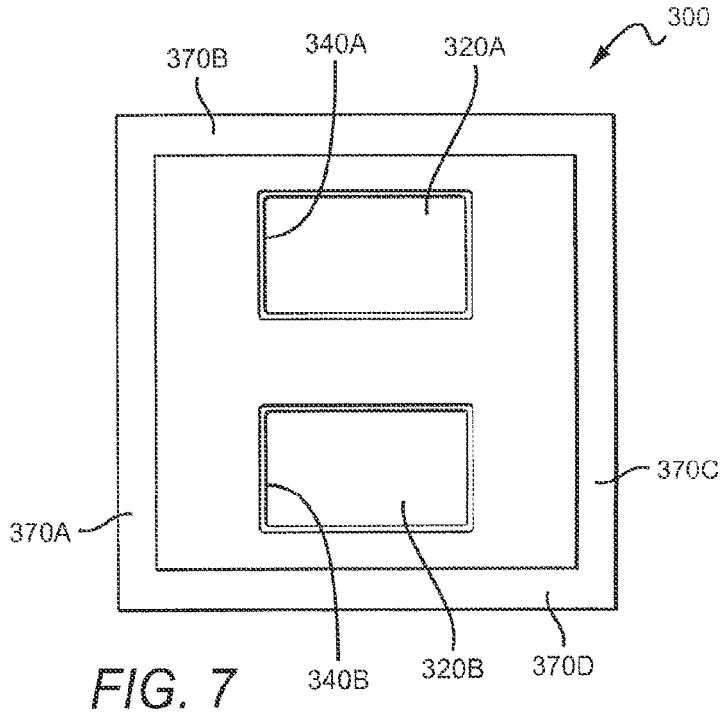
FIG. 7

FIG. 12A
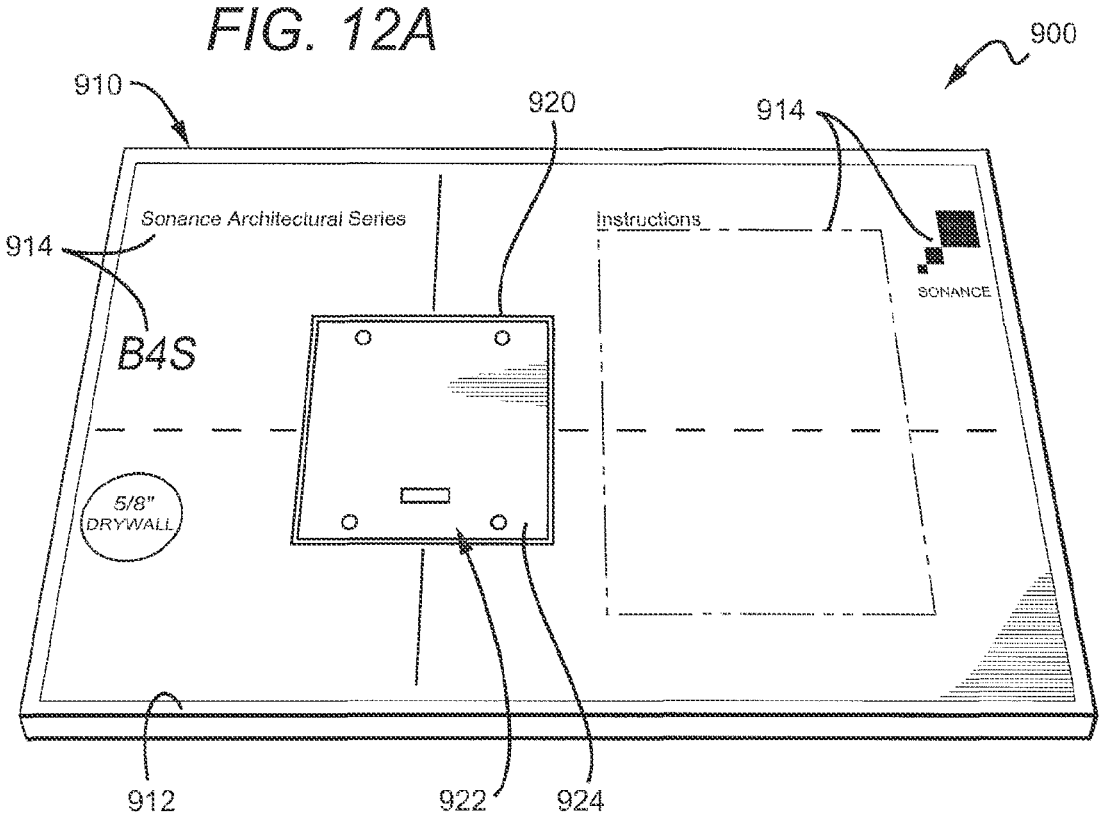
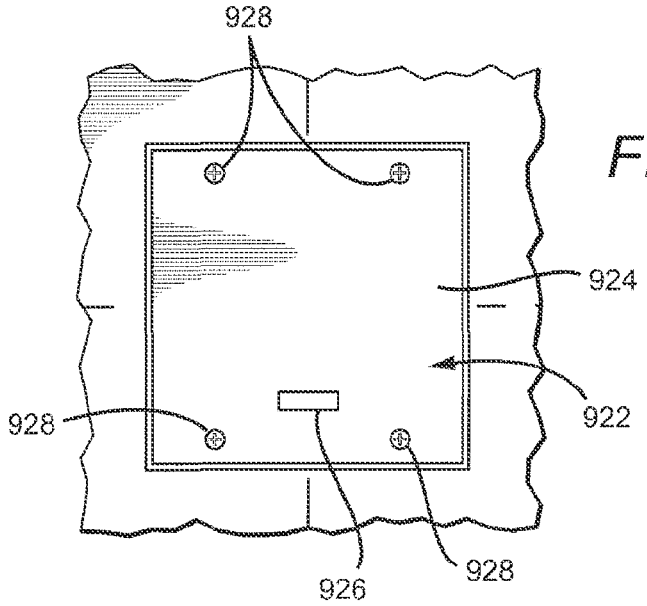
FIG. 12B

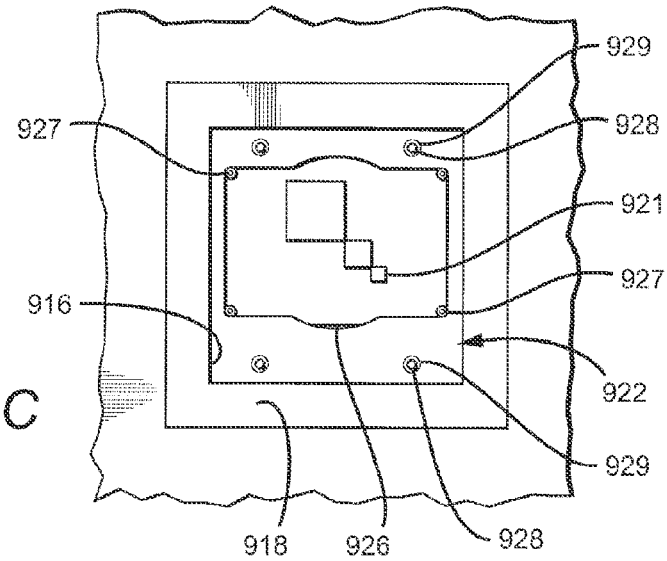
FIG. 12C
FIG. 12D
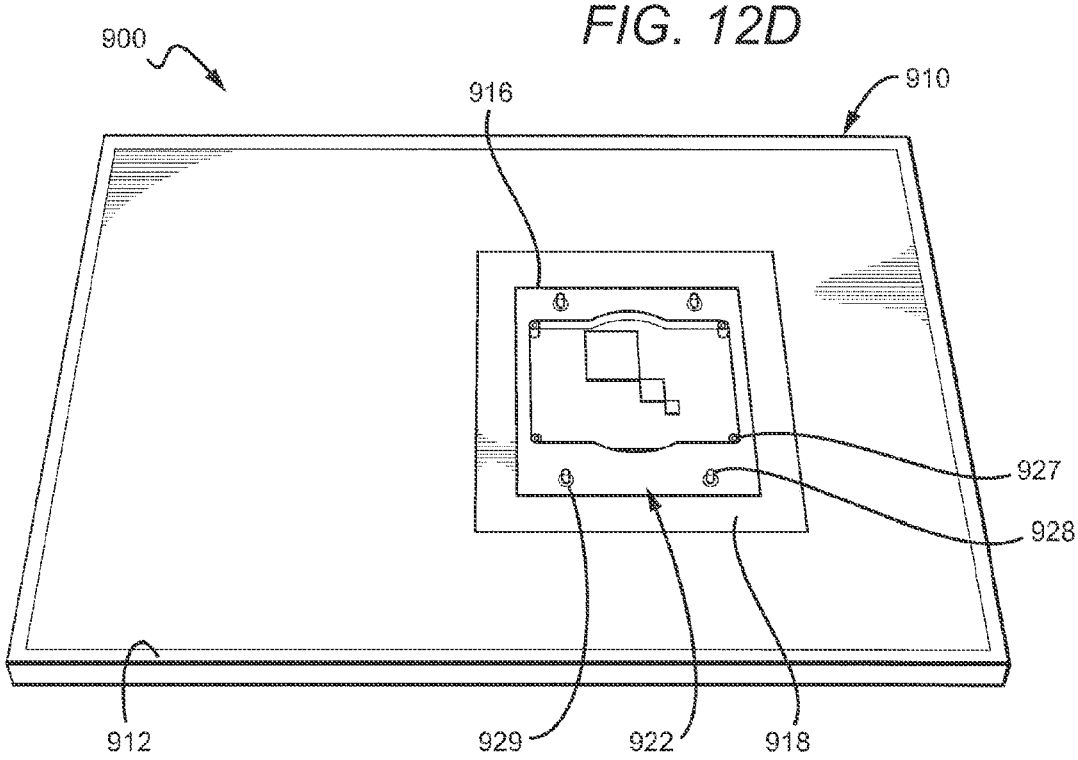

DEVICES AND METHODS FOR FLANGELESS INSTALLATIONS

This application is a divisional of Ser. No. 12/131,459 filed Jun. 2, 2008, now U.S. Pat. No. 8,007,926 which is a divisional of Ser. No. 11/954,667, filed Dec. 12, 2007, now U.S. Pat. No. 7,461,483 which is a continuation-in-part of Ser. No. 11/566,365, filed Dec. 4, 2006, now U.S. Pat. No. 7,699,138 which claims priority to provisional application Ser. No. 60/825,162 filed Sep. 11, 2006 and also claims priority to provisional application Ser. No. 60/950,237 filed Jul. 17, 2007 and International application ser. no. PCT/US07/16404 filed Jul. 19, 2007.

FIELD OF THE INVENTION

The field of the invention is wall and ceiling receptacles.

BACKGROUND

Plasma screens, speakers, light switches, electrical outlets, junction boxes and other components are conventionally mounted by cutting a hole in a wall or ceiling, inserting a bracket, and then seating component being installed to the bracket. Since the cutout is performed at the job site, these conventional installations invariably produce a gap between wall or ceiling and the component being installed. That gap is usually covered with a flange, which can be relatively small, as in the case of flanges used around the edges of the electrical boxes for ceiling lights, speakers, or relatively large, as in the case of face plates for electrical outlets, light switches or other in-wall controls.

It is also known to install wall and ceiling component using flangeless installations. In prior art FIGS. 1A and 1B, for example, a panel 10 is placed behind the wallboard 30. The speaker housing 16 extends out the back side of the panel 10 (i.e. inside the wall or ceiling), and a bracket 14 coupled to the panel 10 has a rim portion 14A that extends above (on the front side of the wall or ceiling) the panel 10 by a distance 15. The drywaller then cuts a hole in wallboard 30 up to the edge of the rim 14. Additional examples are discussed in U.S. Pat. No. 7,032,708 to Popken et al. (April 2006), and U.S. Pat. No. 7,296,280 to Richie (October 1981). These and all other extrinsic materials identified herein are incorporated by reference in their entirety. Where a definition or use of a term in an incorporated reference is inconsistent or contrary to the definition of that term provided herein, the definition of that term provided herein applies and the definition of that term in the reference does not apply.

In the known flangeless installations, a bracket is placed within the opening, a component is seated to the bracket, and the wall or ceiling is finished (typically by plastering) up to the edge of the bracket. Frames are sometimes used in place of a bracket to seat the component, and such cases the wall or ceiling is finished to the edge of the frame rather than to the edge of the bracket. This strategy is often used in hanging windows and doors, and has been adapted to installing speakers by US 2007/0051862 to Monti (March 2007). In other known flangeless installations, as shown by US 2004/0218777 to Hagman (November 2004), a frame is placed within the opening, a component is seated to a panel (i.e. inside the wall) that couples the frame, and an active member without an opening couples the frame forming an acoustic chamber inside the wall, and the wall or ceiling is finished (typically by plastering) up to a perimeter region of the active member.

The grandparent of the present application, Ser. No. 11/548,381 filed Oct. 11, 2006, introduced the idea of installing the mounting bracket into a panel rather than the ceiling or wall. The panel can be significantly, at least two or three times, larger than the size of the opening that receives the component, and in such cases the finishing takes place away from the opening, where the installer has a much easier time producing a superficially continuous junction.

In the '381 application, however, it was still contemplated that the bracket would have a rim that extends above the plane of the panel. That still requires the installer to apply a very thin layer of plaster or other finishing compound up to the rim. What is still needed are methods and apparatus that can achieve a flush-mount appearance in walls, ceilings, and other structures, in which little or even no finishing is required around the periphery of the opening.

SUMMARY OF THE INVENTION

The present invention provides apparatus and methods in which a component is flush-mounted to a wall, ceiling or other substantially flat structure of a building using a panel and receiver assembly.

Preferred panels have compositions and thicknesses that match the structures to which they are being finished. For example, a half-inch thick plasterboard panel would advantageously be installed adjacent a half-inch thick plasterboard wall. Preferred panels have a front facing area of at least twice that of the opening into which the receiver is inserted, and/or extend at least three inches in at least one direction from the face of the receiver. More preferably the front facing area extends at least 5", 7" or 10" in at least one direction from the face of the receiver.

Receivers can range from a simple rim disposed on the inside of the opening, to an extensive bracket and housing extending out the back of the panel. In any event, preferred assemblies have little or no discernable gap between the panel and the receiver. This can be accomplished in any suitable manner, including for example, accurately cutting the opening into which the receiver is installed, and then gluing the receiver to the panel. Where the panel comprises a formed substance such as drywall, another option is to form the panel around the receiver.

The panel can be finished to the structure in any suitable manner, including conventional taping and plastering. Because the panel is large relative to the opening, the finishing takes place away from the component, where finishing is easier to accomplish, and where small defects in the seam would tend not to be attributed to installation of the component. Panels are preferably coupled to an inner, rather than an outer, edge of the structure.

All types of components are contemplated for installation, but especially including components having electrical parts. For example, speakers, lights, switches, wall plugs, wall controls (audio, video, fan), thermostats, fire sprinklers, fire alarms and smoke alarms, mirrors, kitchen appliances, intercoms, air vents, vacuum outlets, security panels, and iPod docks and ports are all contemplated components The component is preferably seated to the assembly in a removable manner, using a detent or biasing mechanism. Special removal tools are contemplated for releasing and withdrawing the component.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 1A is a front perspective view of a prior art flush mount speaker panel.

FIG. 1B is a vertical cross-section of the prior art speaker panel taken along line 1B-1B in FIG. 1A, installed in a wall and with an attached speaker.

FIG. 2 is a plan view of a panel having a sound opening, and a bracket disposed in the sound opening.

FIG. 3 is a front perspective view of the bracket in FIG. 2.

FIG. 4 is a simplified vertical cross-section of the panel and bracket of FIG. 2, taken along line 4-4, installed in a wall and with an attached speaker.

FIG. 5 is a blow up of the circled portion of FIG. 4.

FIG. 7 is a front perspective view of a panel having two speaker openings.

FIGS. 12A and 12B show perspective views of the front of a preferred drywall with a plastic insert.

FIGS. 12C and 12D show the back of the preferred drywall and insert of FIGS. 12A and 12B.

DETAILED DESCRIPTION

Figure 6A:
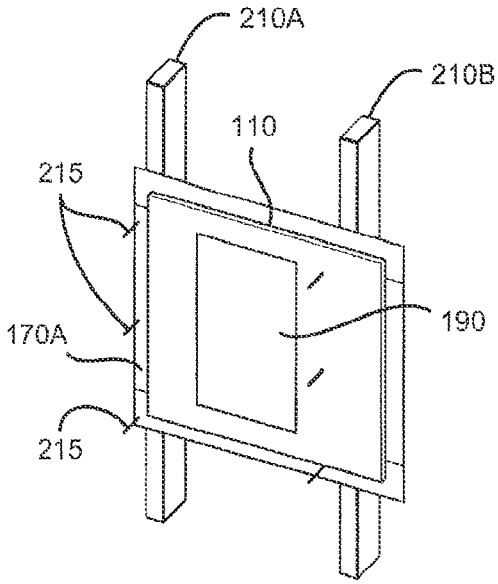
FIG. 6A is a front perspective view of a panel being affixed to two studs in a wall, the panel having a spackle shield covering an opening.

In FIG. 2 a speaker mounting apparatus 100 generally includes a panel 110 with an opening 120, and a bracket 140 disposed in the opening 120, and attachment wings 170A-170D. It should be appreciated that a speaker is used in these figures as an example of a wall mounted component. The same or analogous principles disclosed herein apply to plasma screens, in wall art panels, in wall cabinets or display areas, windows, and so forth.

Panel 110 is a piece of wallboard, wood, plastic, or other material sufficiently strong to support a speaker between two studs of a wall. Where plywood is used, for example, the panel might be as thin as ¼", but would more preferably measure at least ½" or ⅜". Preferred materials include wallboard, Medium Density Fiberboard (MDF), High Density Fiberboard (MDF), Acrylonitrile Butadiene Styrene (ABS), and other materials that closely match various characteristics of drywall. Panel 110 can have any other suitable dimensions, even for example, up to the size of replacing an entire sheet of wallboard. It is preferable for the panel 110, or at least the lateral wings 170A, 170C, to have a width at least six or twelve inches greater than the spacing between studs. The extra width allows the installer considerably greater flexibility in positioning the panel on the wall.

As used herein the term "wall" should be construed broadly to mean any sort of mechanical barrier to which a speaker or similar sized and weighted component could be attached. Thus, the term "wall" includes walls of buildings, machine housings, automobiles, cabinets and so forth, as well as doors and ceilings. Along the same lines, the term "wall section" should be interpreted as any modular portion of the wall. In standard home construction, for example, a wall section would likely be a 4'×8' piece of wallboard.

The opening 120 can also be any suitable shape and size. Preferred openings are rectangular to accommodate rectangular shaped speaker housings, but could also be oval and circular or any other desired shape. The area of the opening is generally dependent on the size of the speaker, and can range up to 80 $in^2$, or larger. Especially preferred openings have an area of at least 20 $in^2$, 40 $in^2$, 60 $in^2$, and even 80 $in^2$. Nevertheless, for stability, it is contemplated that the panel have an opening with a length that is no more than half or one third the length of the panel. In some cases it may be desirable to include multiple openings to accommodate multiple speakers, as in FIG. 7. Preferred embodiments with multiple openings provides at least two openings and at least one of which has an area of at least 20 $in^2$.

Any opening can be positioned in any suitable arrangement relative to the panel 110, and indeed FIG. 2 shows an embodiment where the opening 120 is laterally off center with respect to the opening. Openings could be cut at a job site or elsewhere by an installer, but are more conveniently precut (or molded to include the opening) at the manufacturer. It is possible for a panel to have punch out openings or perhaps cutout lines to facilitate selection of the position of the opening at the job site, but those options are currently disfavored relative to a manufactured opening and a relatively large panel.

The top, bottom, and side wings 170A-170D, respectively, preferably extend from the corresponding edges of the panel 110 by at least about one inch, which is deemed to be sufficient space to conveniently drive a nail or screw into a stud. It is also contemplated, however, that at least one of the wings 170A-170D can extend much longer, perhaps 24 to 30 inches or more. Such long wings can accommodate odd installations where the studs are spread apart at a greater distance from each other than normal. Wings 170A-170D are preferably made of a metal mesh, but can include of any suitable material or materials so long as the material(s) provide(s) sufficient shear strength to support the panel 110 and speaker 16. Metal mesh is also desirable because the wings are advantageously relatively thin, so as not to push out the overlying wallboard, and metals can provide considerable strength with thickness of less than 100 mils. It should also be appreciated that although wings 170A-170D are described herein by separate numerals, they may well be one continuous piece of material.

Bracket 140 is preferably sized and dimensioned to fit snugly into the opening 120, but in any event is screwed or otherwise securely attached to the panel 110. The secure attachment is important since in at least some embodiments, the speaker housing will be attached to the bracket 140 rather than being attached directly to the panel 110. Bracket 140 is preferably molded from polyethylene or other sufficiently strong and durable thermoset plastic, and as shown in greater detail in FIG. 3 bracket 140 includes holes 142 for screws (not shown), a recess 144 into which a speaker grille 18 can be removably secured via a holding mechanism, and a rim 140A, and optional magnets 146 or an optional press fit (not shown).

FIG. 4 also shows a speaker 16A and a grille 18. Speaker 16A should be interpreted as generically representing all practical speakers, including especially dynamic loudspeakers, but also including speakers without moving coils (e.g. piezoelectric speakers, plasma arc loud-speakers, digital speakers, and electrostatic loudspeakers (ESL)). The various wires for power and signal are not show in the Figures, but should be assumed, and can be those conventionally contemplated in the art. Grille 18 can be any suitable speaker grille, but is preferably a metallic mesh grille that press-fits into the opening 120. Additionally or alternatively, the bracket can include a ferrous material that is attracted to magnets 146 in bracket 140.

It should also be appreciated that the same technology can also be used to support items other than speakers, including for example lights, switches, electrical outlets, windows, planters, alcoves and so forth.

As seen in FIG. 5 the rim 140A is sized and dimensioned to extend outwardly from the panel 110 by a very small distance 150, which provides a lip that can readily be used as a stop against which to spread spackle or "mud". Preferred such distances 150 are less than ⅛ inch, and preferably about 1/16 inch, or in metric terms about 1-2 mm. The height 150 of rim 140A above the panel 110 is thus very different from the height 15 of rim 14A above the panel 10 in FIG. 1B. In the prior art configuration the rim 14A extends by more than the combined thickness of the panel 10 and the wallboard 30. Preferably, the panel has a thickness of at least ¼ inch. Also shown in FIG. 5 is an attachment member 148 that helps secure bracket 140 to panel 110.

It should be appreciated that the rim could be separable from the panel. Thus, for example, the rim could be a separately molded piece of plastic, metal or composite that is installed into the opening by the installer, or at a factory.

In FIG. 6A the panel 110 is affixed to two studs 210A, 210B in a wall, and screws 215 are inserted through one of the wings 170A and the panel 110. Of course, the positioning and orientation of the panel could be varied in any suitable manner with respect to the studs, 210A, 210B, including moving the panel 110 higher or lower, left or right, or even tilting the panel clockwise or counterclockwise. Similarly, the studs should be interpreted herein as emblematic of any support structures of a wall, whether or not such structures are technically considered to be studs. In addition, a greater or lesser number of screws could be used, or inserted in some other arrangement than that shown to provide greater or lesser support. The screws could also be replaced or supplemented by some other attachment means such as adhesive. In preparation for spackling, a spackle shield 190 covers the opening 120.

Those skilled in the art will appreciate that the combination of panel and bracket could be provided in several different ways. The panel and bracket could, for example, be joined together at a job site, and indeed the panel could even be "manufactured" at the job site by cutting or punching out the opening. More preferably, however, the panel and bracket are provided as an item of manufacture to the installer by a supplier or manufacturer. The rim of the panel can be pre-installed to the panel. Thus, in various embodiments a kit could contain one or more of a panel, a bracket (or at least a rim around the edges of an opening in the panel), a speaker housing, a spackle shield, and installation screws. The installer would then provide whatever labor is appropriate for the installation, including optionally installing the bracket and/or rim, optionally installing the spackle shield, and optionally mounting the speaker into the speaker housing to the back side of the panel. It is also contemplated that the speaker can be pre-installed into the panel before installation. Alternatively the combination of the panel and bracket can be mounted before installing a rim on the opening.

Figure 6B:
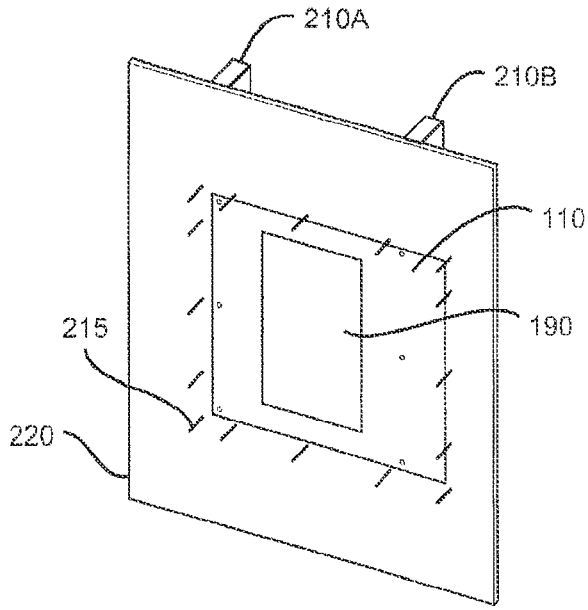
FIG. 6B is a front perspective view of the panel of FIG. 4A, around which drywall has been installed.

In FIG. 6B drywall 220 or other wallboard has been installed on all four sides around the panel 110, and coupled to the wings using screws 215. Where wings are present, as in the embodiment depicted, the drywall 220 overlays the wings, but the wings are sufficiently thin so that the drywall is not noticeable raised. Those skilled in the art will appreciate that although FIG. 6B shows the drywall 220 surrounding the panel 110 as a single piece, it is entirely possible that the drywall could comprise multiple pieces (not shown). It is also contemplated that installation of the drywall 220 might be delegated to drywaller or other tradesman distinct from the panel installer. Nevertheless, the process of installing the panel on one or more wall supports is deemed to include the step of positioning the panel so that it can be approximated in an end-to-end fashion by a piece of wallboard or other wall section.

Figure 6C:
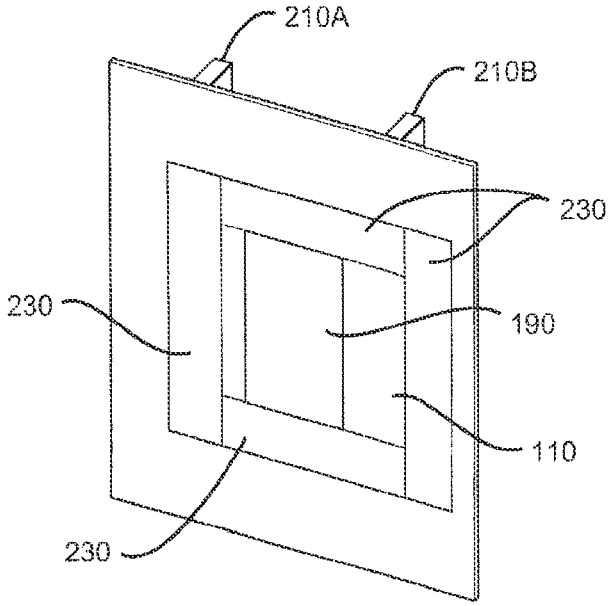
FIG. 6C is a front perspective view of the panel and drywall of FIG. 4B, showing mesh tape.

In FIG. 6C mesh tape 230 is applied along the juxtapositions or other approximations between edges of the panel 110 and edges of the drywall 220. Here again, this step is usually delegated to a professional drywaller, but should be interpreted as being accomplished by the installer of the panel, regardless of which person actually does the work.

Figure 6D:
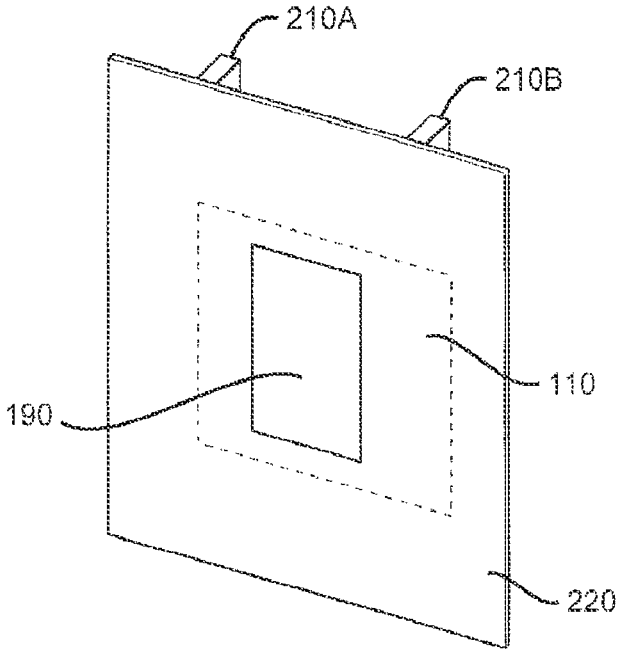
FIG. 6D is a front perspective view of the panel and drywall of FIG. 4C, where the mesh tape has been covered by spackle.
Figure 6E:
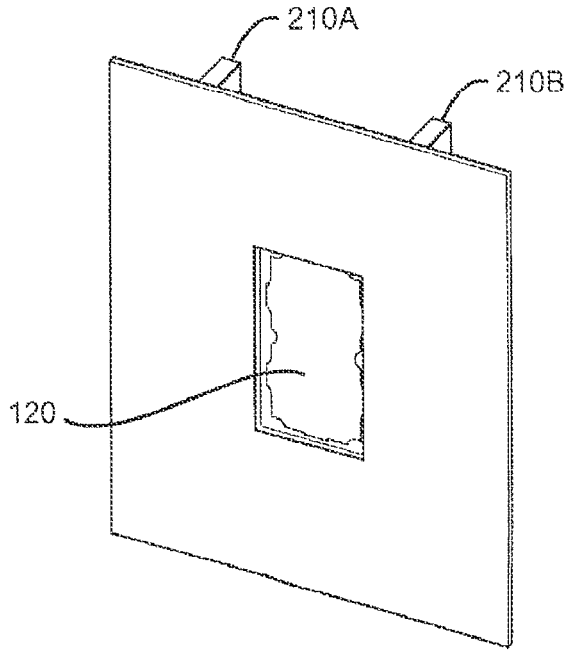
FIG. 6E is a front perspective view of the panel and drywall of FIG. 4C, where the spackle shield has been removed to show the opening.

In FIG. 6D the mesh tape is covered by spackle, and ready for painting, wallpapering, or other surface coating. As used herein, the terms "spackle" and "spackling" should be interpreted as broadly as possible, to include for example plaster and plastering of any type. The point is merely to provide a smoothed out surface that completely or substantially hides the joints between edges of the panel and edges of the drywall.

In FIG. 7 a panel 300 has two speaker openings 320A and 320B. These openings are each preferably at least 40 inch in area, but can be any sizes or shapes, and can have any physically orientation and positioning with respect to each other. The openings 320A, 320B have brackets 340A, 340B, respectively, the panel 300 has wings 370A-370D, all in accordance with the teaching herein.

Figure 8A:
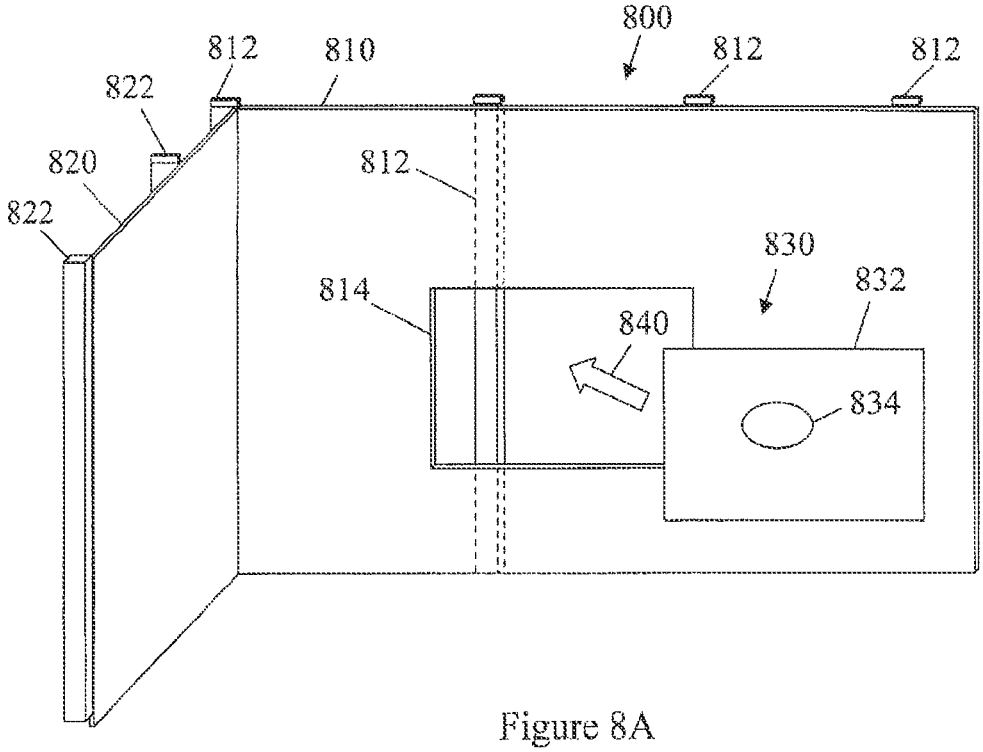
FIG. 8A is a perspective view of two structures in a building (e.g. walls or wall and ceiling), in which an opening has been cut to receive a panel assembly.

In FIG. 8A an installation 800 generally includes building structures 810, 820, an opening 814 on structure 810, and a panel assembly 830 that will installed into the space 814, as shown by arrow 840.

Figure 11:
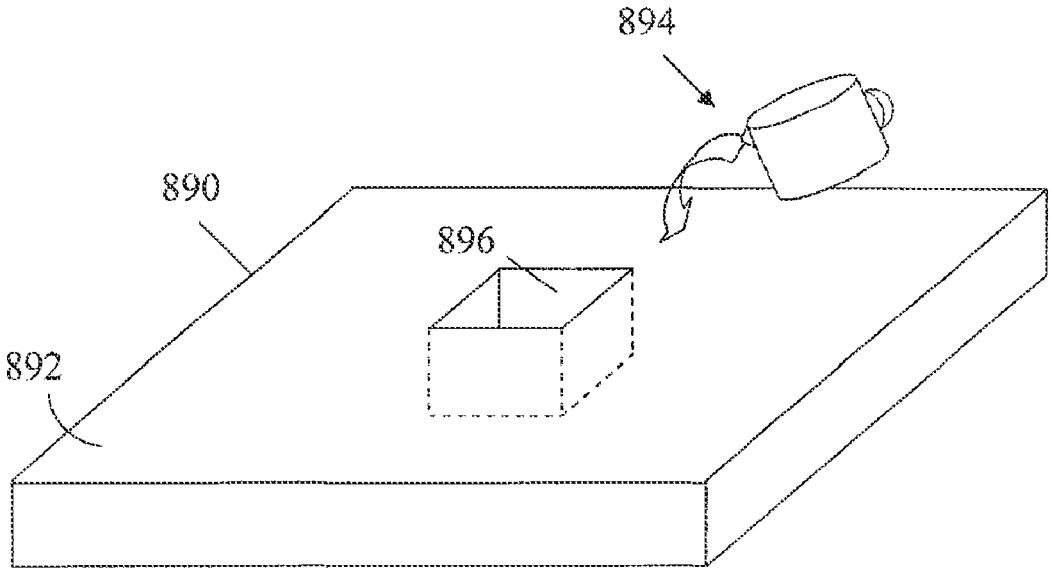
FIG. 11 is a perspective view of a panel assembly being formed by pouring a panel material into a mold.

As used herein, the term "assembly" means an object that has multiple components or functional portions. Thus, the term comprises: (a) multiple pieces that are coupled together in some manner, either temporarily or permanently; and also (b) a single molded object with multiple functional components. By way of example, panel assembly 892 in FIG. 11 is a panel assembly molded as a single piece.

In typical installations, the structures 810, 820 would be adjacent vertical walls, or a vertical wall and a ceiling, and FIG. 8A should be interpreted to include all such embodiments. Thus, for example, where structures 810, 820 are interpreted to be vertical walls, members 812, 822 should be interpreted as studs. Where structure 810 is interpreted as a ceiling, members 812 should be interpreted as joists, and members 822 should be interpreted as horizontal struts. Although the portions of the structures 810. 820 depicted in the figure as substantially flat, those skilled in the art will appreciate that the structures could be curved, or have curved portions. In addition, those skilled in the art will appreciate that structure 810 could exist independently of structure 820.

Structures 810, 820 would typically comprise drywall, which term is used herein generically to include all manner of wallboard, fiberboard, gypsum board, GWB, plasterboard, SHEETROCK® and Gyproc®, and so forth. Additionally or alternatively, structures 810, 820 could comprise other materials, including for example polymers, masonry, ceramics, and acoustic ceiling tile materials or other composites.

Structures 810, 820 can have any suitable dimensions, from only a few square feet or less, to hundreds of square feet or more. Structures 810, 820 will usually, however, have relatively small thicknesses of between ¼" and 1" in thickness.

Panel assembly 830 can be produced at a job site, for example, by cutting a hole out of a piece of drywall. The piece being used in such instances can be cut out from an existing vertical wall or ceiling, and or can be completely new to the job site. Either of those methods could work adequately for drywall, acoustic ceiling tile and other materials that are fairly easy to cut, but for difficult to cut materials, including for example polymers, masonry, and ceramics, the panel assembly can be most conveniently produced in a factory where the panel is dried or cured around a form (see FIG. 11) to define the opening.

As discussed above with respect to FIGS. 2-7, the opening 834 of FIG. 8A can be any suitable size, shape, or number. As currently contemplated, it is desirable that the total front facing area consumed by the opening or openings be relatively small with respect to that of the panel 832. That ratio is preferably at least 3, more preferably at least five. Viewed from another perspective, it is preferred that the panel 832 extend in at least one direction at least 3 inches from the closest edge of the opening 834 for light or other simple switches, electrical outlets and so forth, and at least 5 inches for lights, more complicated switches and other controllers, speakers and so forth. Where the component has a front-facing surface area of at least 25 $in^2$, the panel 832 extend in at least one direction at least 12, 18, or even 24 inches from the closest edge of the opening 834.

Figure 8B:
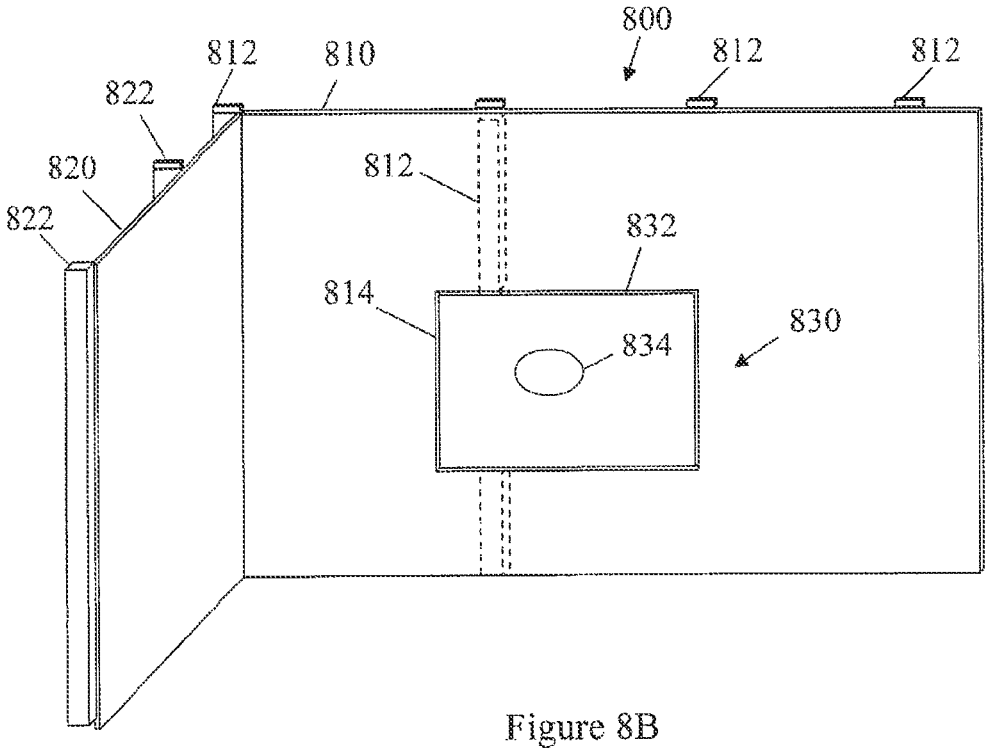
FIG. 8B is a perspective view of the two structures of FIG. 8A, in which the panel assembly has been placed within the opening.

In FIG. 8B the panel assembly 830 has been placed within the space 814. There will almost always be some gap between the edges of the panel assembly 830 and those of the surrounding structural component 810, ranging in typical installations from zero (where the panel assembly 830 is abutted against the structural component 810), and perhaps ⅛" to ¼". Indeed, there will almost always be multiple different gaps around the edge of the panel assembly. Where the workmanship is sloppy, or the project is especially difficult, the gap in some sections can be larger. In addition, it is contemplated that an intermediate member (not shown), as for example a paper, shim, or even a frame can be installed in the gap between the panel assembly 830 and the structural component 810. As long as the edges of the assembly and the structure are somewhat near each other, and the gap can be finished such that an at least superficially continuous junction is established between them, the edges are considered to be approximated.

Figure 8C:
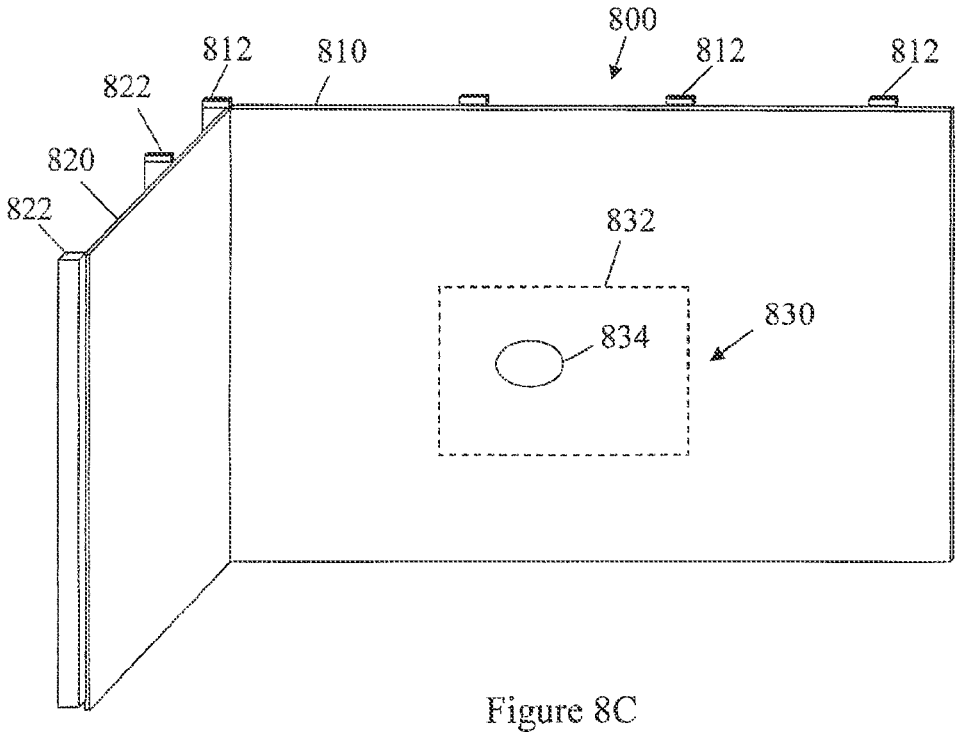
FIG. 8C is a perspective view of the two structures of FIG. 8B, in which the approximated edges of the panel assembly and the wall have been finished to provide a superficially continuous junction.

In FIG. 8C the approximated edges of the panel assembly and the structure have been finished to provide an at least superficially continuous junction. As used herein the term "at least superficially continuous junction" refers to a junction that appears to casual observation to be seamless. By way of example, a good workman-like job in taping and plastering adjacent sections of wall board is considered herein to produce an at least superficially continuous junction, especially where subsequent painting or wallpapering eliminates any seam apparent to casual observation.

Figure 9:
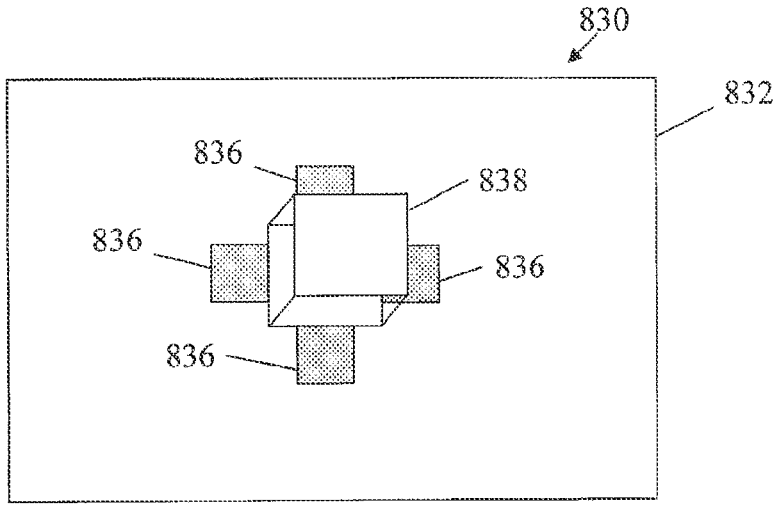
FIG. 9 is a rear view of the panel assembly of FIGS. 8A-8C, showing a receiver and attachments.

In FIG. 9 a rear view of the panel assembly 830 of FIGS. 8A-8C shows a receiver 838 and attachments 836 of the receiver to the panel 832. The receiver 838 in this instance is an open box, but all manner of alternative receivers are also contemplated. For example, receivers could be tubular or have some other shape, and could be completely or partially closed, and can have punch outs such as those found on a typical electrical connection box.

The attachments 836 are shown as four wings, extending from the four sides of the receiver 838, and then glued, nailed, stapled or otherwise affixed to the panel 832. Those skilled in the art will appreciate that still other methods could be used, including forming the panel 832 around the wings. Still further, it is contemplated that wings could be eliminated altogether. In a ¾" or 1" thick fiberboard, for example, a collar pressed into the opening, or used as a form around which the fiberboard is made, might have sufficient strength to hold a relatively lightweight component.

Figure 10A:
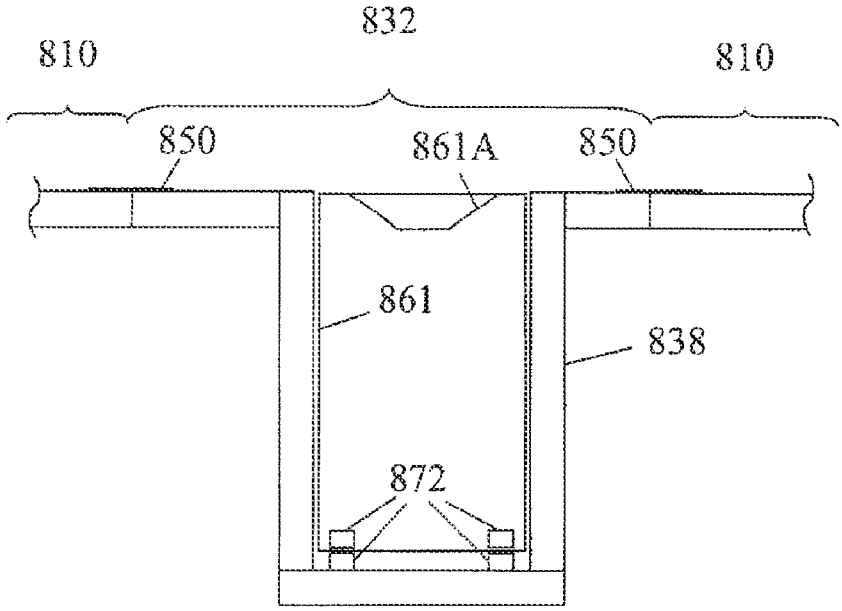
FIG. 10A is a horizontal cross-section of a panel assembly and speaker component installed in a wall, where the component is seated to the assembly using magnets.
Figure 10B:
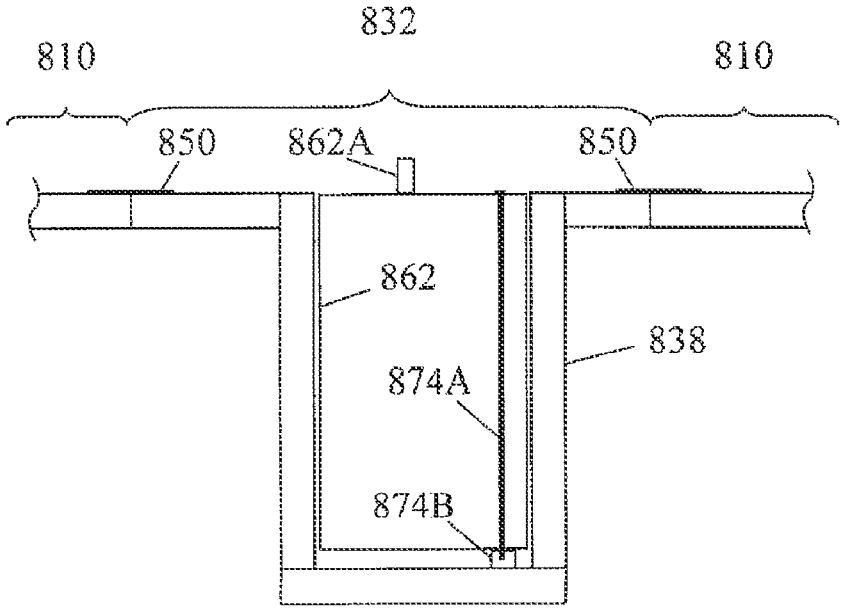
FIG. 10B is a horizontal cross-section of a panel assembly and switch component installed in a wall, where the component is seated to the assembly using a long bolt.
Figure 10C:
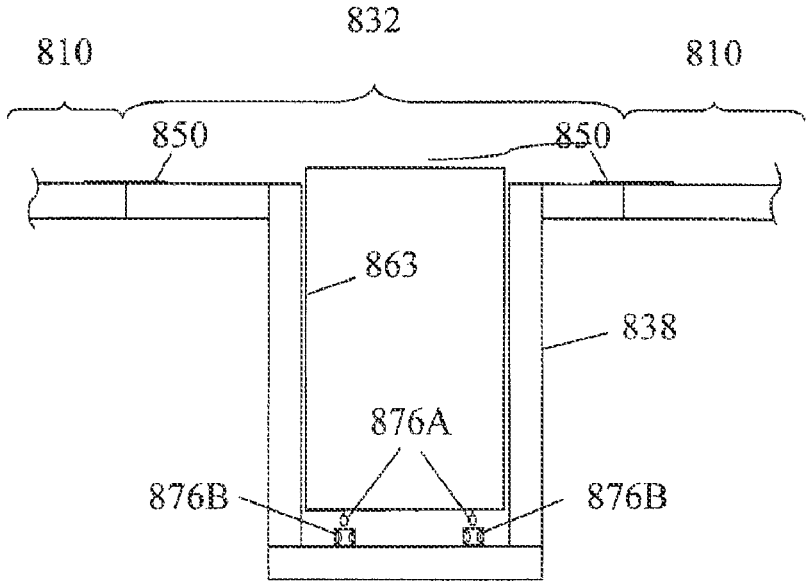
FIG. 10C is a horizontal cross-section of a panel assembly and light component installed in a wall, where the component is seated to the assembly using a detent.
Figure 10D:
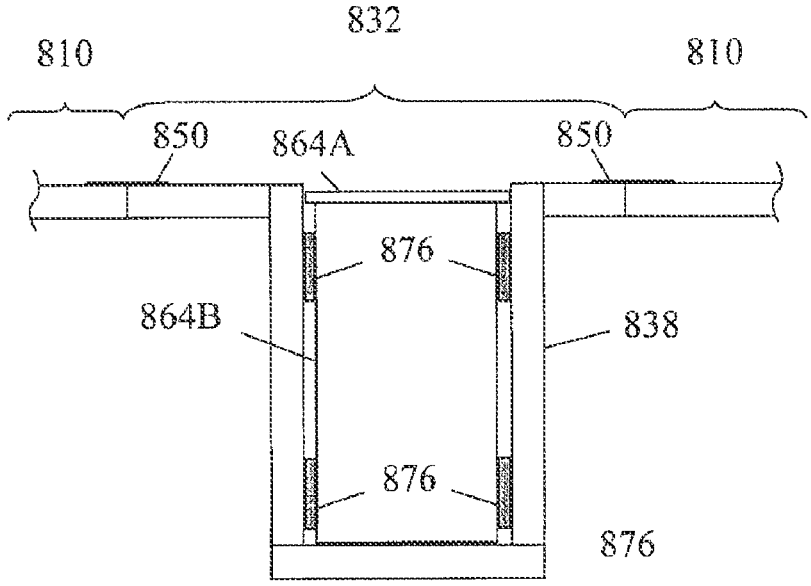
FIG. 10D is a horizontal cross-section of a panel assembly and a generic component installed in a wall, where the component is seated to the assembly using friction surfaces.

FIGS. 10A-10D depict alternative mechanisms for seating various components 861-864 within receivers 838. In FIG. 10A the mechanism comprises magnets 872. In FIG. 10B, the mechanism comprises a long threaded bolt 874A that is turned into a nut 874B. In FIG. 10C the mechanism comprises detents that fit within biasing members 876B. In FIG. 10D the mechanism comprises a compressible polymer or fabric that fits in the gap between the rear portion 864B of the component 864, and the receiver 838. In this particular example, the facing plate 864A of the component 864 is larger across than the rear portion 864B.

In the Figures component 861 is a speaker or other speaker assembly 861A, component 862 is a light or other switch, (showing toggle 862A), component 863 is a light, light fixture or other light assembly, and component 864 is a generic component that should euphemistically be viewed as an electrical outlet, or any other reasonably installable component. Of course, the combinations expressly depicted in the Figures are merely examples, and thus it should be appreciated that one could combine any of the components 861-864 with any of the depicted seating mechanisms, or indeed any suitable seating mechanism.

FIGS. 10A-10D also demonstrate that the face of the components are only optionally made completely flush with the face of the panel 832 when they seat with the receiver 838. FIG. 10D, for example, shows a face portion 864A that is recessed from the face of the panel 832. Here, those skilled in the art will appreciate that the recess is exaggerated to assist visualization. In practice, any such recess or extension would likely be less than $\frac{1}{8}^{th}$ inch. Furthermore, it is contemplated that the components can be easily removed by extraction tools, such as a screwdriver and the like, to provide for simpler change of installation.

FIG. 11 is a perspective view of a panel assembly 892 being formed by pouring a panel material from container 832 into a mold 894. This process brings the poured material right up against the frame portion that defines the opening 896, regardless of any irregularity or other difficulties with the shape of the opening. All manner of panel materials are contemplated, including for example curable plastics, and masonry composites.

FIG. 12A is a front perspective view of a panel assembly 900 having a piece of drywall 910 with a plastic insert 922 about the opening 920. The drywall 910 is preferably shipped with a paper covering 912 around the outer edges for protection. The covering 912 can either be removed or left in place when finishing the drywall 910 to surrounding wall (not shown). The drywall 910 can advantageously include instructions, trademark markings, (collectively 914), and so forth.

The insert 922 has a shallow lip 922 that extends out from the front side of the drywall 910 by about ⅛ inch to 1/16 inch, or in metric terms about 1-2 mm. Those distances are to be reasonable to provide a stop up to which an installer can feather a smooth edge of spackle or "mud".

As best seen in FIG. 12B, insert 922 also has an attachment plate 924 that is recessed from the front side by about ½", or in metric terms a little over 1 cm. Of course, other distances could alternatively be used for the recess. In this particular instance plate 924 has an optional level 926 that can be used by the installer to install the drywall 910 so that the plate 924 is level. Optional screws or bolts 928 can be used to tighten the insert 922 against the drywall 910.

FIGS. 12C and 12D show the back of drywall 910 and insert 922, including: the back side of the level 926; optional protrusions 921 forming part of the logo; the open ends of screws or bolts 928, which are seated in female threaded receivers 929; and additional female threaded receivers 927 to receive bolts or screws (not shown) used to attach a speaker or other device (not shown) against the back of the plate 924. Insert 922 can be glued against the drywall 910 using glue 916, and the back side of the junction between the insert 922 and the drywall 910 can be covered with tape 918 to improve appearance.

Figure 13:
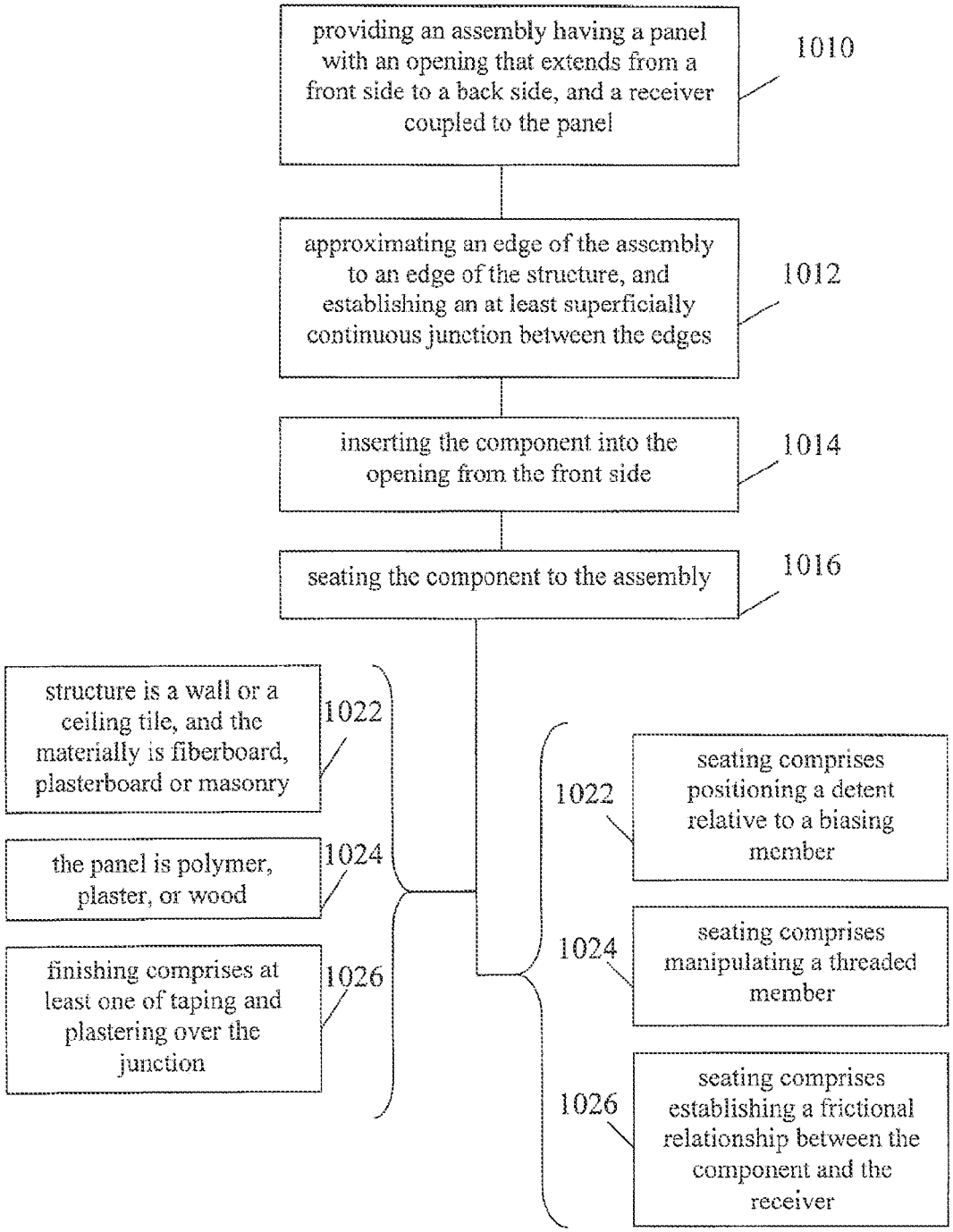
FIG. 13 is a schematic of steps in a method according to inventive concepts disclosed herein.

FIG. 13 is a schematic of steps in a method according to inventive concepts disclosed herein.

Thus, specific embodiments and applications of flangeless speaker devices and methods have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of installing a component in a substantially flat structure of a building, comprising:

mounting a panel to an opening in the structure where the panel has a panel opening that extends from a front side of the panel to a back side of the panel and a receiver disposed within the panel opening; wherein the receiver is sized and dimensioned to fit snugly into the panel opening and comprises a first rim extending outwardly from the front side of the panel, a second rim extending outwardly from the back side of the panel, and an attachment member extending 90 degrees from a side of the receiver into the panel;

approximating an edge of the panel to an edge of the structure, establishing at least one superficially continuous junction between the edges by at least one of taping and plastering over the junction; and coupling the component to the receiver such that a front surface of the component is mounted substantially flush with the front side of the panel.

2. The method of claim 1, wherein the step of providing the assembly comprises building the panel from at least one of fiberboard and plaster.

3. The method of claim 1, wherein the step of providing the assembly comprises building the panel from a material having a composition similar to that of the wall.

4. The method of claim 1, wherein the step of providing the assembly comprises building the panel from at least one of a polymer, plaster, and wood.

5. The method of claim 1, wherein the assembly includes a lip that extends away from a plane defined by the front side of the panel to a height of less than ¼ inch, and further comprising spackling adjacent the lip.

6. The method of claim 1, wherein the step of coupling comprises frictionally coupling the component to the receiver.

7. The method of claim 1, wherein the step of coupling comprises using a detent to couple the component to the receiver.

8. The method of claim 1, wherein the step of coupling comprises threadedly coupling the component to the receiver.

9. The method of claim 1, wherein the step of coupling comprises magnetically coupling the component to the receiver.

10. The method of claim 1, further comprising providing an extraction tool that can be used to unseat the component from the receiver.

* * * * *